US006879100B2

(12) United States Patent
Hanahara et al.

(10) Patent No.: US 6,879,100 B2
(45) Date of Patent: Apr. 12, 2005

(54) EL ELEMENT AND ILLUMINATION COMPRISING IT

(75) Inventors: Tetsuro Hanahara, Fukui (JP); Kuniharu Matsuoka, Fukui (JP); Yoshiharu Abe, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 43 days.

(21) Appl. No.: 10/332,437

(22) PCT Filed: May 15, 2002

(86) PCT No.: PCT/JP02/04682

§ 371 (c)(1),
(2), (4) Date: Jul. 21, 2003

(87) PCT Pub. No.: WO02/093982

PCT Pub. Date: Nov. 21, 2002

(65) Prior Publication Data

US 2004/0012947 A1 Jan. 22, 2004

(30) Foreign Application Priority Data

May 16, 2001 (JP) ..... 2001-146214

(51) Int. Cl.[7] ..... H05B 33/04; H05B 33/12
(52) U.S. Cl. ..... 313/506; 313/512; 313/112
(58) Field of Search ..... 313/506, 512, 313/112; 315/169.3; 428/917

(56) References Cited

U.S. PATENT DOCUMENTS 5,239,228 A * 8/1993 Taniguchi et al. ..... 313/512
6,198,217 B1 * 3/2001 Suzuki et al. ..... 313/504

FOREIGN PATENT DOCUMENTS

| | | |
|---|---|---|
| JP | 55-171921 | 12/1980 |
| JP | 62-35236 | 7/1987 |
| JP | 9-198902 | 7/1997 |
| JP | 10-274948 | 10/1998 |
| JP | 10-283096 | 10/1998 |
| JP | 2000-48953 | 2/2000 |
| JP | 2000-91068 | 3/2000 |
| WO | WO96/30919 | 10/1996 |

* cited by examiner

*Primary Examiner*—Ashok Patel
(74) *Attorney, Agent, or Firm*—RatnerPrestia

(57) ABSTRACT

An EL element includes a light-transmitting substrate, a light-transmitting electrode layer over a first surface of the substrate, a luminescent layer over the light-transmitting electrode layer, a back electrode layer over the luminescent layer, and a waterproof insulating layer covering the light-transmitting electrode layer, the luminescent layer, and the back electrode layer. The EL element and a lighting unit have excellent resistance against water. The light-transmitting electrode layer, the luminescent layer, and the back electrode layer end before an outer periphery of the substrate as well as before an end face of the substrate at each hole or notch in the substrate. This arrangement provides the EL element and the lighting unit with the excellent resistance against water.

19 Claims, 7 Drawing Sheets

EL ELEMENT AND ILLUMINATION COMPRISING IT

This application is a U.S. national phase application of PCT international application PCT/JP02/04682.

TECHNICAL FIELD

The present invention relates to an EL element used for illuminating an operating section or a display section of an electronic apparatus, such as a portable telephone or a personal computer, and relates to a lighting unit using this EL element.

BACKGROUND ART

Electronic apparatuses including a portable telephone and a notebook. computer have better functions and cover a broader spectrum, and an EL element and a lighting unit that are used in these apparatuses is accordingly demanded to have various functions and lighting different from those for stationary apparatuses have been accordingly demanded.

A conventional EL element and a lighting unit including the EL element will be described with reference to FIGS. 6 and 7.

FIG. 6 is a sectional view of the conventional EL element. Light-transmitting substrate 1 formed of film has plural holes 1A or notches. Light-transmitting electrode layer 2 of, for example, indium tin oxide, is formed over the whole bottom surface of substrate 1 by sputtering, a method using electron beam or the like.

Luminescent layer 3 of synthetic resin containing light-emitting material, such as zinc sulfide, dispersed therein, dielectric layer 4 of synthetic resin including barium titanate dispersed therein, and back electrode layer 5 of resin including silver or carbon are laid over electrode layer 2 by printing.

Luminescent layer 3, dielectric layer 4, and back electrode layer 5 are covered with insulating layer 6 of epoxy resin or polyester resin. Electrodes (not shown) are connected to light-transmitting electrode layer 2 and back electrode layer 5, respectively, and extend sideward. Thus, EL element 10 is obtained.

FIG. 7 is a sectional view of the lighting unit including EL element 10. Push button 11 made of insulating resin includes, at its top surface, display part 11A which is, for example, semitransparent or milk-white and is exposed in the form of, for example, a letter, a mark, or a design. Switch contact 12 is provided below push button 11. In the switch contact, wiring board 13 and flexible insulating film 14 are put together to face each other across insulating spacers 15 each having both surfaces coated with adhesive. Switch contact 12 is configured as a membrane switch including plural fixed contacts 13A on a top surface of wiring board 13 and plural movable contacts 14A on a bottom surface of insulating film 14, and contacts 13A and 14A face each other at a predetermined space.

EL element 10 having the above structure is disposed on a top surface of switch contact 12 and has hole 1A through which push part 11B projects downward from push button 11 or has a notch for positioning the element. Case 16 made of insulating resin covers these elements and has, at its top side, a hole through which push button 11 projects vertically movably. This arrangement provides a lighting unit.

When specified push button 11 is pressed downward, insulating film 14 of the above-described switch is pressed with push part 11B and sags, thereby corresponding movable contact 14A on the bottom surface of film 14 contacts with corresponding fixed contact 13A on the top surface of wiring board 13. This allows switch contact 12 to establish electrical connection and disconnection.

Upon a voltage being applied between light-transmitting electrode layer 2 and back electrode layer 5 of EL element 10 via the electrodes, luminescent layer 3 between layers 2 and 5 emits light. Plural push buttons 11 illuminates from behind with the light, which thus helps identification of buttons 11 even in dark.

Luminescent layer 3, dielectric layer 4, back electrode layer 5, and insulating layer 6 are formed over a large film having light-transmitting electrode layer 2 formed on its whole surface, and subsequently, a resulting element is divided into discrete conventional EL elements 10 each having a predetermined shape. While luminescent layer 3, dielectric layer 4, and back electrode layer 5 are covered with insulating layer 6, light-transmitting electrode layer 2 has an exposed end.

In cases that EL element 10 is used in the lighting unit, water, upon splashing on push button 11 or case 16, enters through push part 11B of button 11 or through the hole in the top side of case 16 and wets an outer periphery of EL element 10 or the end of light-transmitting electrode layer 2 at each hole 1A. This causes EL element 10 to have degraded insulation and reduced brightness.

SUMMARY OF THE INVENTION

An EL element includes a light-transmitting substrate, a light-transmitting electrode layer provided over a first surface of the substrate and ending before an end face of the substrate, a luminescent layer provided over the light-transmitting electrode layer and ending before the end face of the substrate, a back electrode layer provided over the luminescent layer and ending before the end face of the substrate, and a waterproof insulating layer covering the light-transmitting electrode layer, the luminescent layer and the back electrode layer.

The EL element and a lighting unit have excellent resistance to water.

DESCRIPTION OF THE PREFERRED EMBODIMENTS

Figure 1:
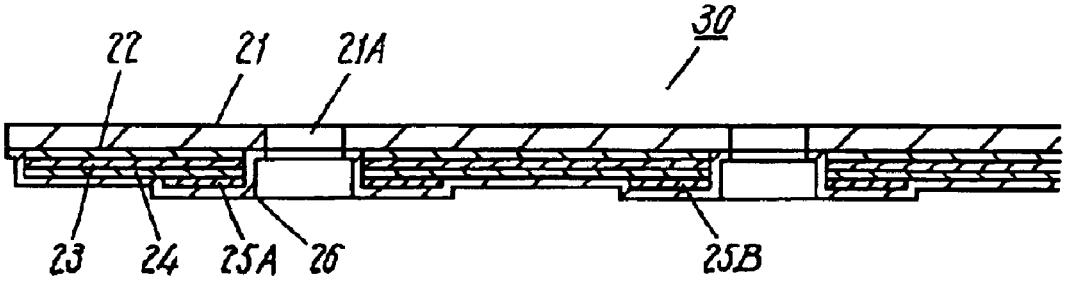
FIG. 1 is a sectional view of an EL element in accordance with a first exemplary embodiment of the present invention.

Exemplary embodiments of the present invention will be described with reference to FIGS. 1–5. Elements similar to those of a conventional EL element are denoted by the same reference numerals and will not be described in detail.

Exemplary Embodiment 1

FIG. 1 is a sectional view of an EL element in accordance with a first exemplary embodiment of the present invention.

Light-transmitting substrate 21 formed of a film, glass, resin or the like has plural holes 21A or notches. Light-transmitting synthetic resin including indium tin oxide or the like dispersed therein is applied by printing to form light-transmitting electrode layer 22 which ends before an outer periphery of substrate 21 as well as before an end face of substrate 21 at each hole 21A or notch.

Electrode layer 22 is overlaid with, by printing, luminescent layer 23 and dielectric layer 24 made of resin that has a high dielectric constant and includes barium titanate or the like dispersed therein. Luminescent layer 23 is made of resin, such as fluororubber resin or cyanic resin, which has a high dielectric constant and includes light-emitting material, such as zinc sulfide, dispersed therein. Dielectric layer 24 is overlaid partly with plural back electrode layers 25A and 25B made of resin including silver or carbon by printing, thereby providing plural light-emitting parts.

Light-transmitting electrode layer 22, luminescent layer 23, dielectric layer 24, back electrode layers 25A, 25B and a bare surface of substrate 21 are covered with waterproof insulating layer 26 made of, e.g. epoxy resin or polyester resin. Electrodes (not shown) are connected to light-transmitting electrode layer 22 and back electrode layers 25A, 25B, respectively, and extend sideward. Thus, EL element 30 is obtained.

Figure 2:
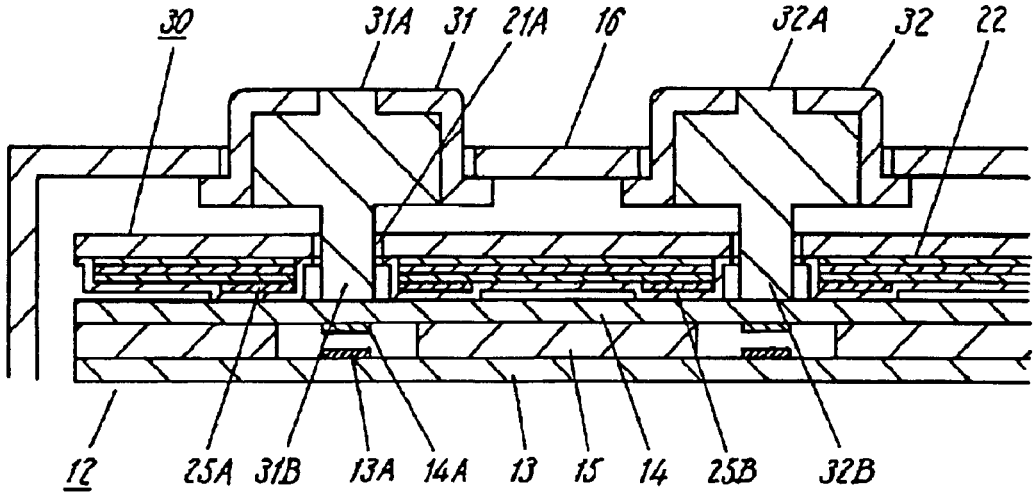
FIG. 2 is a sectional view of a lighting unit in accordance with the first embodiment.

FIG. 2 is a sectional view of a lighting unit including EL element 30. Dark-colored push buttons 31 and 32 made of insulating resin, such as ABS resin, polycarbonate, or acrylic resin, include display parts 31A and 32A at their respective top surfaces. Display parts 31A and 32A may be semitransparent or milk-white and are each exposed in the form of a letter, a mark, a design or the like.

In switch contact 12 below push buttons 31, 32, wiring board 13 and flexible insulating film 14 are put together to face each other across insulating spacers 15 each having both surfaces coated with adhesive. Switch contact 12 is a membrane switch including plural fixed contacts 13A on a top surface of wiring board 13 and plural movable contacts 14A on a bottom surface of insulating film 14. Contacts 13A and 14A face each other at a predetermined space.

EL element 30 is disposed on a top surface of switch contact 12 and has holes 21A through which push parts 31B and 32B project downwardly from push buttons 31 and 32, respectively, or has notches for locating the element. Case 16 made of insulating resin covers these elements and has, at its top side, holes through which buttons 31 and 32 project vertically movably, respectively. This provides a lighting unit.

When push button 31 or 32 is pressed downward, insulating film 14 of the above-described switch is pressed by push part 31B or 32B and sags, thereby allowing corresponding movable contact 14A contacts with corresponding fixed contact 13A on the top surface of wiring board 13. This allows switch contact 12 to establish electrical connection and disconnection.

As shown in FIG. 1, light-transmitting electrode layer 22, luminescent layer 23, dielectric layer 24, and back electrode layers 25A, 25B have their ends before the outer periphery of substrate 21 as well as before the end face of substrate 21 at each hole 21A or notch. These layers and the bare surface of substrate 21 are covered with waterproof insulating layer 26. EL element 30 thus has resistance against water even in case that push buttons 31, 32 or case 16 is splashed with water or the like.

EL element 30 is formed partly with the back electrode layers 25A and 25B by printing, thereby forming plural light-emitting parts. Thus, when, for example, a voltage is applied between light-transmitting electrode layer 22 and back electrode layer 25A via the electrodes, only a part of luminescent layer 23 above back electrode layer 25A emits light, thereby making push button 31 to illuminate from behind with the light.

Upon a voltage being applied between light-transmitting electrode layer 22 and back electrode layer 25B, only a part of luminescent layer 23 above back electrode layer 25B emits light, thereby making push button 32 to illuminate from behind with the light. This arrangement allows the push buttons 31 and 32 to illuminated separately.

Upon a voltage being applied between light-transmitting electrode layer 22 and each of back electrode layers 25A and 25B, the light-emitting parts emit light, thereby push buttons 31 and 32 are backlit. This facilitates the identification of buttons 31 and 32 even in the dark.

According to the present embodiment, light-transmitting electrode layer 22, luminescent layer 23, and back electrode layers 25A, 25B are laid over a bottom surface of substrate 21 and have their ends before the outer periphery of substrate 21 as well as before the end face of substrate 21 at each hole 21A or notch. Since the whole bottom side of substrate 21 is covered with waterproof insulating layer 26, EL element 30 has the excellent resistance against water. This allows the lighting unit including EL element 30 to have excellent resistance against water.

Functioning as partial back electrode layers, the back electrode layers 25A and 25B allow only a specified part to emit light and allow plural parts to emit light simultaneously.

In the above description, light-transmitting electrode layer 22 and luminescent layer 23 are formed over the whole surface, while back electrode layers 25A and 25B are formed at respective parts. However, the present invention is feasible even if light-transmitting electrode layers 22 or luminescent layers 23 are formed at their respective parts to function as partial light-transmitting electrode layers or partial luminescent layers.

In case that it is not necessary for EL element 30 to emit light in parts, light-transmitting electrode layer 22, luminescent layer 23 and the back electrode layer may be all formed over the whole surface and covered with insulating layer 26.

The present embodiment has referred to the two buttons and the two light-emitting parts. However, the number of buttons and the number of light-emitting parts are not limited to two.

Exemplary Embodiment 2

Elements similar to those in the first embodiment are denoted by the same reference numerals and will not be described in detail.

Figure 3:
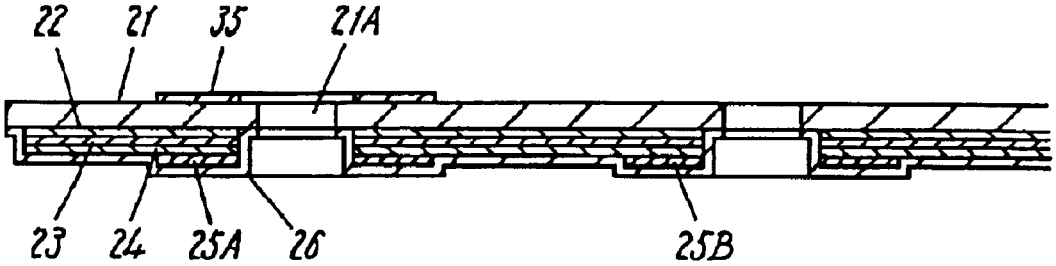
FIG. 3 is a sectional view of an EL element in accordance with a second exemplary embodiment of the present invention.

FIG. 3 is a sectional view of an EL element in accordance with a second exemplary embodiment of the present invention. Similarly to the first embodiment, substrate 21 has plural holes 21A or notches. Light-transmitting electrode layer 22 ends before an outer periphery of substrate 21 as well as before an end face of substrate 21 at each hole 21A or notch. Similarly to the first embodiment, electrode layer 22 is overlaid with luminescent layer 23, dielectric layer 24 and plural back electrode layers 25A and 25B by printing. These layers and a bare surface of substrate 21 are covered with waterproof insulating layer 26.

Synthetic resin including fluorescent dye or fluorescent pigment dispersed therein is printed on a top surface part of substrate 21 corresponding to back electrode layer 25A to form color conversion layer 35. Thus, the EL element is obtained.

Similarly to the first embodiment, upon a voltage being applied between light-transmitting electrode layer 22 and each of back electrode layers 25A and 25B of the EL element, all of plural light-emitting parts emit light. Upon a voltage being applied separately, that is, between light-transmitting electrode layer 22 and back electrode layer 25A or between electrode layer 22 and back electrode layer 25B, only a part of luminescent layer 23 above layer 25A or 25B emits light.

In case that luminescent layer 23 and color conversion layer 35 emit, for example, blue light and orange light, respectively, the light-emitting part above back electrode layer 25B emits blue light, which is identical to that of luminescent layer 23. The light-emitting part above back electrode layer 25A emits orange light as light emitted by luminescent layer 23 which is converted by color conversion layer 35 over back electrode layer 25A.

As described above, the present embodiment provides the EL element capable of various lighting since color conversion layer 35 on the top surface of substrate 21 above back electrode layer 25A allows plural light-emitting parts to emit lights of different colors.

In the above description, color conversion layer 35 is provided on the top surface of substrate 21. However, the present invention is feasible even when this color conversion layer 35 is provided between a bottom surface of substrate 21 and luminescent layer 23.

Figure 4:
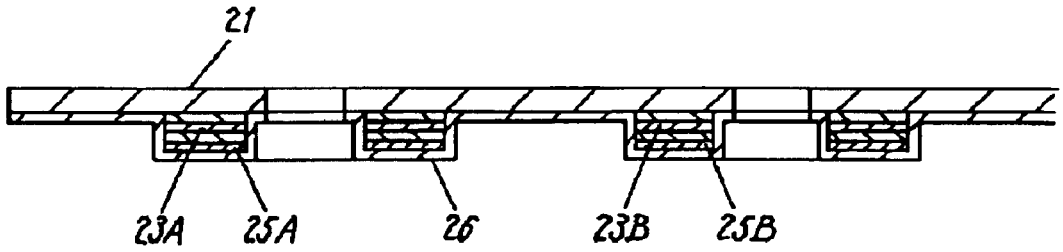
FIG. 4 is a sectional view of another EL element in accordance with the second embodiment.

As shown in a sectional view of FIG. 4, another EL element capable of various lighting can be obtained with plural luminescent layers 23A and 23B at respective parts corresponding to back electrode layers 25A and 25B, respectively, so that luminescent layers 23A and 23B may emit lights of different colors.

Figure 5:
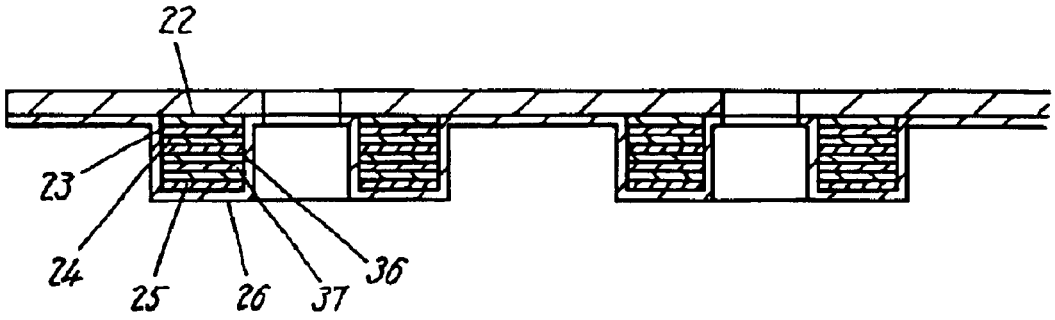
FIG. 5 is a sectional view of another EL element in accordance with the second embodiment.
Figure 6:
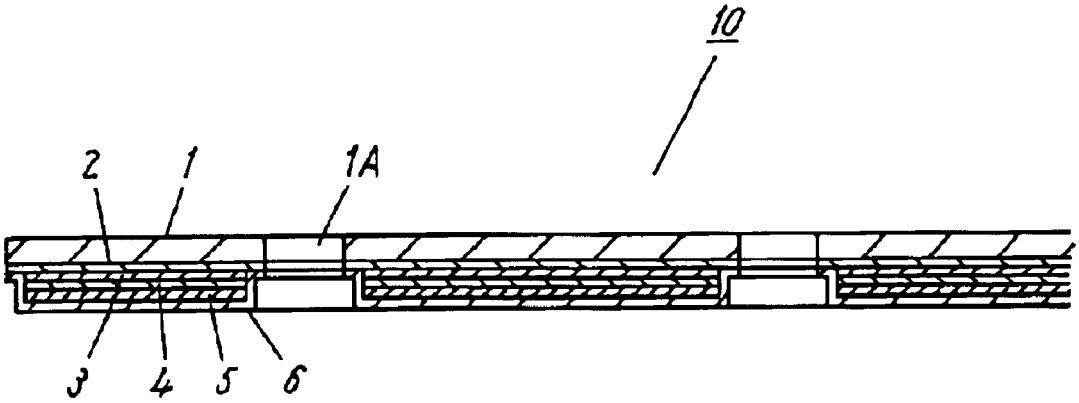
FIG. 6 PRIOR ART
FIG. 6 is a sectional view of a conventional EL element.
Figure 7:
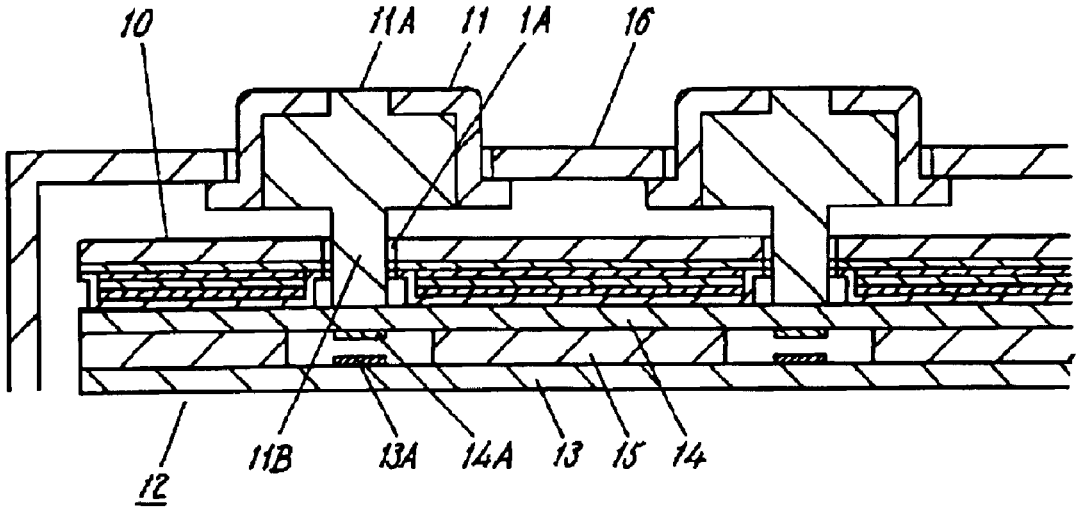
FIG. 7 PRIOR ART
FIG. 7 is a sectional view of a conventional lighting unit.

As shown in a sectional view of FIG. 5, plural light-transmitting electrode layers 36 and plural luminescent layers 37 emitting colors different from those of luminescent layers 23 may be formed over plural luminescent layers 23, respectively. This arrangement allows plural light-transmitting electrode layers 36 to change to different ones and allows the layers to emit light in combined color. This increases variety of lighting.

That is, if luminescent layers 23 and 37 emit, for example, blue-green light and orange light, respectively, a voltage applied between light-transmitting electrode layers 22 and 36 causes luminescent layer 23 to emit blue-green light, while a voltage applied between light-transmitting electrode layer 36 and back electrode layer 25 causes luminescent layer 37 to emit the orange light. Depending on selection of the electrode layers to which the voltage is applied, the light to be emitted can be changed in color.

Upon a voltage being applied between light-transmitting electrode layers 22 and 36 as well as between light-transmitting electrode layer 36 and back electrode layer 25, luminescent layers 23 and 37 both emit their respective lights. In this case, these lights are combined, and consequently, an EL element emits white light.

Being included in a lighting unit of the first embodiment, the EL element capable of emitting light of different colors at the light-emitting parts and of changing light between the different colors provides a lighting unit capable of various lighting. For example, the unit illuminates a specified push button with light different in color from light for other push buttons, and changes the color of the light for the push button according to requirement.

In the above descriptions, the membrane switch including wiring board 13 and insulating film 14 that are put together is used as switch contact 12. However, the switch contact may be another switch contact, for example, which includes fixed contacts on the wiring board and movable contacts made of resilient metal foil disposed over respective fixed contacts and each having a center portion protruding like a dome. In this switch contact, each movable contact is turned inside out by the push button for connection with and disconnection from the fixed contact. The present invention is feasible with dome-like movable contacts made of rubber or elastomer used for connection with and disconnection from the respective fixed contacts, or with a single push switch used in place of the above-described switch contact.

INDUSTRIAL APPLICABILITY

According to the present invention, an EL element is provided which has excellent resistance against water, and a lighting unit using the EL element is provided.

What is claimed is:

1. An EL element comprising:

a light-transmitting substrate;

a light-transmitting electrode layer over a first surface of said substrate, said light-transmitting electrode layer having an end face ending before an edge of said substrate;

a luminescent layer over said light-transmitting electrode layer, said luminescent layer having an end face ending before said edge of said substrate;

a first back electrode layer partly overlapping said luminescent layer, said first back electrode layer having an end face ending before said edge of said substrate; and a waterproof insulating layer covering said light-transmitting electrode layer, said luminescent layer, and said back electrode layer.

2. The EL element of claim 1, wherein said luminescent layer comprises a plurality of partial luminescent layers over said light-transmitting electrode layer.

3. The EL element of claim 2, wherein at least two of said plurality of partial luminescent layers emit lights of different colors.

4. The EL element of claim 1, wherein said light-transmitting electrode layer comprises a plurality of partial light-transmitting electrode layers over said substrate.

5. The EL element of claim 1, further comprising a second back electrode layer partly overlapping said luminescent layer and not overlapping said first back electrode layer.

6. The EL element of claim 5, wherein said waterproof insulating layer covers said second back electrode layer.

7. The EL element of claim 1, further comprising:

a color conversion layer over a second surface of said substrate.

8. The EL element of claim 1, further comprising:

a color conversion layer between said substrate and said luminescent layer.

9. The EL element of claim 1, wherein said waterproof insulating layer covers a bare surface of said substrate uncovered by said light transmitting electrode layer.

10. An EL element comprising:

a light-transmitting substrate;

a plurality of light-transmitting electrode layers over a first surface of said substrate, said plurality of light-transmitting electrode layers ending before an edge of said substrate, said plurality of light-transmitting electrode layers overlapping with each other;

a plurality of luminescent layers for emitting lights of different colors from each other, said plurality of luminescent layers ending before said edge of said substrate, said plurality of luminescent layers and said plurality of light-transmitting electrode layers being disposed alternately;

a back electrode layer over a luminescent layer of said plurality of luminescent layers farthest from said substrate, said back electrode layer ending before said edge of said substrate; and a waterproof insulating layer covering said plurality of light-transmitting electrode layers, said plurality of luminescent layers, and said back electrode layer.

11. The EL element of claim 10, wherein at least one of said plurality of luminescent layers comprises a plurality of partial luminescent layers.

12. The EL element of claim 11, wherein at least two of said plurality of partial luminescent layers emit lights of different colors from each other.

13. The EL element of claim 10, wherein at least one of said plurality of light-transmitting electrode layers comprises a plurality of partial light-transmitting electrode layers.

14. A The EL element of claim 10, wherein said back electrode layer comprises a plurality of partial back electrode layers.

15. The EL element of claim 10, further comprising:

a color conversion layer over a second surface of said substrate.

16. The EL element of claim 10, further comprising:

a color conversion layer between said substrate and said plurality of luminescent layers.

17. The EL element of claim 10, wherein said plurality of luminescent layers overlap each other.

18. A lighting unit comprising:

an EL element comprising:

a light-transmitting substrate;

a light-transmitting electrode layer over a first surface of said substrate, said light-transmitting electrode layer having an end face ending before an edge of said substrate;

a luminescent layer over said light-transmitting electrode layer, said luminescent layer having an end face ending before said edge of said substrate;

a back electrode layer partly overlapping said luminescent layer, said back electrode layer having an end face ending before said edge of said substrate; and a waterproof insulating layer covering said light-transmitting electrode layer, said luminescent layer, and said back electrode layer;

a plurality of push buttons over a first surface of said EL element; and a switch contact for establishing electrical connection and disconnection when said plurality of push buttons is pressed and released, wherein said EL element illuminates a predetermined push button of said plurality of push buttons.

19. A light unit comprising:

an EL element comprising:

a light-transmitting substrate;

a plurality of light-transmitting electrode layers over a first surface of said substrate, said plurality of light-transmitting electrode layers ending before an edge of said substrate, said plurality of light-transmitting electrode layers overlapping with each other;

a plurality of luminescent layers for emitting lights of different colors from each other, said plurality of luminescent layers and said plurality of light-transmitting electrode layers being disposed alternately;

a back electrode layer over a luminescent layer of said plurality of luminescent layers farthest from said substrate, said back electrode layer ending before said edge of said substrate; and a waterproof insulating layer covering said plurality of light-transmitting electrode layers, said plurality of luminescent layers, and said back electrode layer;

a plurality of push buttons over a first surface of said EL element; and a switch contact for establishing electrical connection and disconnection when said plurality of push buttons is pressed and released, wherein said EL element illuminates a predetermined push button of said plurality of push buttons.

* * * * *